United States Patent [19]

DoMinh

[11] 4,433,037

[45] Feb. 21, 1984

[54] HEAT ERASABLE PHOTOGRAPHIC ELEMENT AND PROCESS COMPRISING SILVER HALIDE

[75] Inventor: Thap DoMinh, Rochester, N.Y.

[73] Assignee: Eastman Kodak Company, Rochester, N.Y.

[21] Appl. No.: 398,483

[22] Filed: Jul. 15, 1982

[51] Int. Cl.[3] ..... G03C 11/00; G03C 5/16; G03C 1/00

[52] U.S. Cl. ..... 430/19; 430/349; 430/354; 430/617; 430/936

[58] Field of Search ..... 430/936, 617–620, 430/19, 349, 354

[56] References Cited

U.S. PATENT DOCUMENTS

| | | | |
|---|---|---|---|
| 3,250,618 | 5/1966 | Stewart et al. . | |
| 3,438,776 | 4/1969 | Yudelson . | |
| 3,672,904 | 6/1972 | de Mauriac | 430/617 |
| 3,748,138 | 7/1973 | Bissonette . | |
| 3,764,329 | 10/1973 | Lee . | |
| 3,802,888 | 4/1974 | Willits . | |
| 3,856,524 | 12/1974 | Bissonette | 430/936 |
| 4,128,428 | 12/1978 | Ikenoue et al. | 430/936 |
| 4,173,482 | 11/1979 | Akashi et al. . | |
| 4,268,617 | 5/1981 | Mitsui et al. | 430/936 |
| 4,273,860 | 6/1981 | Adin . | |
| 4,308,341 | 12/1981 | DoMinh . | |

FOREIGN PATENT DOCUMENTS

| | | |
|---|---|---|
| 1461892 | 1/1977 | United Kingdom . |

OTHER PUBLICATIONS

Research Disclosure, Oct. 1976, No. 15027.
Research Disclosure, Dec. 1978, No. 17643.
Research Disclosure, Aug. 1979, No. 18436.
Research Disclosure, Jun. 1978, No. 17029.
Research Disclosure, Apr. 1974, No. 12013.

*Primary Examiner*—Mary F. Downey
*Attorney, Agent, or Firm*—Richard E. Knapp

[57] ABSTRACT

A heat erasable photographic material comprises, in reactive association, in a suitable binder:

(a) photographic silver halide;

(b) a mild oxidizing agent which consists essentially of a cobalt(III) amine salt which, upon heating of the photographic material, will oxidize any latent image silver present in the photographic material; and (c) a weak complexing agent for the oxidized silver.

Any latent image silver in the photographic material is erased upon brief uniform heating of the photographic material. The photographic material is light handleable prior to uniform heating. After uniform heating, the photographic material is capable of being imagewise exposed and processed to produce a developed silver image. The photographic material may comprise a selected silver halide developing agent. A developed image is produced in a heat erasable photographic material by (1) first uniformly heating the material at a temperature and for a time sufficient to erase any latent image silver in the photographic material, then (2) exposing the material to light to produce a developable image and (3) thereafter developing an image. The photographic material is preferably a photothermographic material.

53 Claims, No Drawings

HEAT ERASABLE PHOTOGRAPHIC ELEMENT AND PROCESS COMPRISING SILVER HALIDE

BACKGROUND OF THE INVENTION

1. Field of the Invention

This invention relates to a photographic material, preferably a photothermographic material, comprising photographic silver halide and a combination of components that enables any latent image silver in the material to be erased by a simple uniform heating step prior to imagewise exposure and development of the photographic material. The invention also relates to a process of producing an image by means of such a photographic material.

2. Description of the State of the Art

Photographic silver halide materials that are reversibly desensitized to light are known. These are described in, for example, U.S. Pat. No. 3,250,618. Such photographic silver halide materials are resensitized by heating the photographic material prior to imagewise exposure. Such photographic materials employ chemical desensitizers, such as mercuric chloride or triammonium hexachlororhodite, that may permanently adversely affect sensitometric properties of the photographic silver halide. These photographic materials do not comprise a combination of components that enable latent image silver to be heat erasable.

Photothermographic materials that comprise a source of halide ions for formation of photosensitive silver halide prior to exposure are also known. An example of such a photothermographic material that becomes photosensitive upon heating is described in U.S. Pat. No. 4,173,482. The photothermographic material does not contain photosensitive silver halide prior to heating, that is the photographic silver halide is not pre-formed. Such photothermographic materials in which the silver halide is formed in situ do not enable use of conventional silver halide emulsion making procedures and technology. Control of formation of silver halide grain size, shape and distribution as in conventional silver halide emulsion preparation is not possible.

Cobalt(III) amine salts are also known in imaging materials, such as described in U.K. Patent Specification No. 1,461,892. Up to now it was considered desirable to avoid cobalt(III) amine salts in preparing silver halide photographic materials because the cobalt(III) amine salts were thought to produce undesired desensitization. It has now been found that cobalt(III) amine salts can be desirable in photographic silver halide materials to enable the silver halide materials to be light handleable.

A problem has existed in providing photographic silver halide materials, such as photothermographic materials, that (1) are preparable and handleable in light prior to imagewise exposure and processing, (2) enable use of conventional silver halide emulsion preparation technology without the need for darkroom or safelight conditions in preparation, and (3) provide minimum density areas of an exposed and developed image which have reduced fog without the need for an added antifoggant. The art has not suggested an answer to this problem.

The art contains no suggestion that the answer to such a problem is in a heat erasable photographic material. The term "heat erasable photographic material" herein means a photographic silver halide composition or photographic silver halide element that has the capability, upon being heated in a heating step, of changing any latent image silver in the composition or element to a form which does not adversely affect imagewise exposure and development of the photographic material subsequent to the heating step. A latent silver image prior to development in which a photographic material is capable of being erased by heating the photographic material. No heat erasable photographic material has been suggested in the photographic art.

SUMMARY OF THE INVENTION

It has been found that a heat erasable photographic material, preferably a heat erasable photothermographic material, comprises, in reactive association, in a suitable binder, preferably a hydrophilic binder such as gelatin:

(a) photographic silver halide;

(b) a mild oxidizing agent which consists essentially of a cobalt(III) amine salt which upon heating of the photographic material, will oxidize any latent image silver present in the photographic material; and (c) a weak complexing agent for the oxidized silver.

If the photographic material is a photothermographic material, then a silver halide developing agent, such as a reductic acid, which does not adversely affect the heat erasability and subsequent exposure and thermal processing of the photographic material, is also preferable in reactive association with the silver halide.

A method of producing an image in a heat erasable photographic element, according to the invention, comprises the steps, in sequence:

(A) heating the element at a temperature and for a time sufficient to erase any latent image silver in or on the photographic silver halide;

(B) exposing the element resulting from step (A) to light to produce a developable image in the silver halide photographic emulsion layer; then (C) developing the image produced in step (B).

A photographic element, according to the invention, is also useful in thermographic imaging in which the heat erasable photographic silver halide material is uniformly exposed to light followed by imagewise exposure to heat. The imagewise heating step is at a temperature and for a time sufficient to erase any latent image silver in the imagewise heated areas. Optionally, the element after imagewise heating is uniformly exposed to light and then developed, such as by development in an aqueous developer bath or solution.

The heat erasable photographic silver halide material, according to the invention, permits the photographic material to be prepared, packaged and handled without the need for darkroom or safe-light conditions prior to initial heating of the material. An advantage of such photographic materials, according to the invention, is that they can be prepared for imagewise exposure by a simple heating step prior to use. A further advantage observed for the photographic materials is that the minimum density areas of the exposed and developed image are lower and have less fog than expected without the need for an added antifoggant.

The heat erasable photographic silver halide material, according to the invention, is optionally useful as a renewable photographic material, a reusable photographic material and as a reversal photographic material. For example, the photographic material is optionally useful to record a latent image which is erasable by simply heating the photographic material.

DETAILED DESCRIPTION OF THE INVENTION

The exact mechanism by which the heat erasable photographic silver halide material operates is not fully understood. Upon initial exposure of the photographic silver halide to light, latent image silver is formed on or in the silver halide as illustrated by the following reaction:

$$\text{AgX} + \text{Co (III) hexammine} \xrightarrow{\text{light}} \text{Ag}^{\circ} + \text{Co (III) hexammine} + \text{X}^{-}$$

It is believed that the cobalt(III) amine salt changes the latent image silver upon heating the photographic material by the following illustrative reaction:

$$\text{Ag}^{\circ} + \text{Co (III) hexammine} \xrightarrow[\text{(mild oxidizing agent) heat}]{} \text{Ag}^{+} + \text{Co}^{+2} + \text{NH}_3$$

The silver ion ($Ag^+$) forms a complex with the weak complexing agent. After the initial heating step, the photographic element is capable of forming latent image silver by exposure to light. The photographic silver halide is not significantly desensitized at any stage of the process prior to development and fixing or stabilization of a silver image.

When a reducing agent, such as ascorbic acid, is present in the photographic silver halide material during the initial heating step, it appears that the reducing agent scavenges all the cobalt(III) amine salt on the silver halide or in the vicinity of the silver halide by the following illustrative redox reaction:

$$\text{ascorbic acid} + \text{Co (III) hexammine} \xrightarrow[\text{heat}]{} \text{oxidized ascorbic acid} + \text{Co}^{+2} + \text{NH}_3$$

The ammonia produced by this reaction appears to act as a base which neutralizes some acid in the photographic material to shift the pH of the material to a higher region more conducive to development. It is believed that the pH of the photographic material increases about 2 pH units, such as from about pH 4.0 to about pH 6.0 which is benificial to development. A suitable reducing agent such as ascorbic acid is necessary in the photographic material to provide optimum development during heat processing. Such a reducing agent in the photographic material is not necessary if conventional processing, such as processing in a silver halide developer solution or bath is to be carried out.

A weak complexing agent for oxidized silver is necessary in the photographic silver halide material to produce the desired heat erasing of latent image silver during the initial heating step. Many compounds known in the photothermographic art as thermal solvents, also known as melt formers, are useful in photographic materials according to the invention as weak complexing agents for oxidized silver. Examples of useful weak complexing agents for oxidized silver are methylurea, 1,3-dimethylurea, urea, hydantoin, succinimide, sulfamide and acetamide. The weak complexing agent for oxidized silver should be selected to avoid adverse affects on the photographic silver halide and other components in the photographic material. For example, N-methylacetamide provides undesired reduction in photographic speed in certain photographic silver halide materials according to the invention. Useful weak complexing agents for oxidized silver are selected from, for example, those compounds designated as thermal solvents or melt formers described in, for instance, U.S. Pat. No. 3,438,776 and *Research Disclosure,* October 1976, Item No. 15027, the description of which is incorporated herein by reference. An optimum weak complexing agent for oxidized silver will depend upon such factors as the desired image, particular photographic silver halide, processing steps and conditions, particular cobalt(III) amine salt in the photographic material, other components in the photographic material and processing temperature. The term "weak" regarding a complexing agent for oxidized silver herein means a degree of complexing strength for silver ion that is less than the complexing strength of sodium thiosulfate and ammonium thiocyanate but that is sufficient to complex silver ion formed in a photographic silver halide material according to the invention upon initial heating.

The concentration of weak complexing agent for silver ion in the photographic silver halide material should be sufficient to enable heat erasing of latent image silver to occur upon initial heating of the photographic silver halide material. An optimum concentration of weak complexing agent for silver ion will depend upon such factors as the particular photographic silver halide and the photographic material, the particular cobalt(III) amine salt, processing conditions and other described factors. A preferred concentration of weak complexing agent for silver ion is within the range of about 20 mg to about 200 mg per mmole of silver in the photographic material. It is believed that a eutectic mechanism occurs in the photographic material during the initial heating step as a result of the presence of the weak oxidizing agent for silver ion. Optionally, the weak oxidizing agent for silver ion can act as a humectant to increase the level of water in the photographic material which is known to facilitate silver development.

The photographic materials, according to the invention, comprise a photographic silver halide. Examples of useful photographic silver halides are silver chloride, silver bromide, silver bromoiodide, silver chlorobromoiodide, silver iodide and mixtures thereof. The photographic silver halide is generally present in the photographic material in the form of an emulsion which is a dispersion of the photographic silver halide in a suitable binder. The photographic silver halide is present in a range of grain sizes from fine grain to coarse grain. The composition containing the photographic silver halide is prepared by any of the well known procedures in the photographic art, such as described in *Research Disclosure,* December 1978, Item No. 17643, the disclosure of which is incorporated herein by reference. The photographic silver halide material optionally contains addenda commonly present in photographic silver halide materials, such as chemical sensitizers, brighteners, antifoggants, emulsion stabilizers, light absorbing or scattering materials, hardeners, coating aids, plasticizers, lubricants and antistatic materials, matting agents, development modifiers and other addenda described in *Research Disclosure,* December 1978, Item No. 17643.

The photographic silver halide can comprise, for example, internal image photographic silver halide and internally sensitized covered grain silver halide to produce positive images.

The photographic silver halide is optionally spectrally sensitized by means of spectral sensitizing dyes, as described in *Research Disclosure,* December 1978, Item No. 17643. Spectral sensitizing dyes which are useful in photographic materials of the invention include, for example, polymethine sensitizing dyes which include the cyanines, merocyanines, complex cyanines and merocyanines, including tri-, tetra- and polynuclear cyanines and merocyanines, as well as oxonols, hemioxonols, styryls, merostyryls and streptocyanines. Combinations of spectral sensitizing dyes are useful.

The photographic material contains a range of concentrations of photographic silver halide. An optimum concentration of photographic silver halide will depend upon such factors as the desired image, processing conditions, particular cobalt(III) amine salt, particular weak complexing agent for silver ion, and other components in the photographic material. A preferred concentration of photographic silver halide in the photographic material, according to the invention, is within the range of about 0.05 mmole to about 2.0 mmoles of photographic silver halide per $dm^2$ of support of the photographic material.

The photographic silver halide, cobalt(III) amine salt and weak complexing agent for silver ion, according to the invention, are in any suitable location in the photographic material which produces the heat erasing of latent image silver without adversely affecting sensitometric properties upon initial heating of the photographic material. According to the invention, the photographic silver halide, cobalt(III) amine salt and the weak complexing agent for silver ion are preferably in the same layer of a photographic element according to the invention. If desired, a portion of the silver halide, cobalt(III) amine salt or weak complexing agent for silver ion is in a layer contiguous to the photographic silver halide layer of a photographic element. The term "in reactive association" herein means that the photographic silver halide, cobalt(III) amine salt and the weak complexing agent for silver ion are in a location with respect to each other which enables the desired heat erasability of the photographic silver halide material and permits the desired sensitometric properties upon initial heating of the photographic material prior to imagewise exposure and processing.

The photographic material, according to the invention, comprises a concentration of at least one mild oxidizing agent consisting essentially of a cobalt(III) amine salt which enables thermal erasing of latent image silver in a photographic material according to the invention. The term "mild" oxidizing agent herein means an oxidizing agent that has a degree of oxidizing strength that (a) will in a photographic silver halide material, upon heating the photographic silver halide material to a temperature within the range of about 80° C. to about 180° C. oxidize any latent image silver in the photographic silver halide material and (b) will not prevent latent image forming and keeping capability of the photographic silver halide material. The "mild" oxidizing agent preferably has about the degree of oxidizing strength in a photographic silver halide material of cobalt(III) hexammine trifluoroacetate. This degree of oxidizing strength of the mild oxidizing agent is preferably about 0.10 Volt as measured in a standard redox potential test as described by R. J. Cox in "Photographic Sensitivity", Academic Press, 1973, Chapter 15.

Cobalt(III) amine salts are known in the photographic art. Preferred cobalt(III) amine salts useful in photographic materials, according to the invention, are selected from those described in, for example, *Research Disclosure,* Item No. 16845; *Research Disclosure,* Item No. 12617; *Research Disclosure,* Item No. 18535; *Research Disclosure,* Item No. 15874; *Research Disclosure,* Item No. 18436; U.S. Pat. No. 4,273,860; U.K. Published Application No. 2,012,445A; the disclosures of which are incorporated herein by reference.

Trivalent cobalt amine complexes, that is cobalt(III) amine complexes, are generally most useful because the ligands are relatively tenaciously held in these complexes and released when the cobalt is reduced to the (II) state. Preferred cobalt(III) complexes are those having a coordination number of 6. Useful amine ligands in cobalt(III) complexes, according to the invention, include, for example, methylamine, ethylamine, ammines and amino acids such as glycine. The term "ammine" refers to ammonia, when functioning as a ligand, whereas "amine" indicates the broader class noted above. The ammine complexes are highly useful in producing desensitization according to the invention.

The cobalt(III) amine complexes include neutral compounds which are entirely free of either anions or cations. The cobalt(III) amine complexes also include one or more cations and anions as determined by the charge neutralization rule. However, the terms "anion" and "cation" refer to non-ligand anions and non-ligand cations unless otherwise indicated. Preferred cations are those which produce readily soluble cobalt(III) amine complexes, such as alkali metals and quaternary ammonium cations.

A wide variety of anions are useful, such as those listed in *Research Disclosure,* Item No. 18436. The choice of an optimum anion depends in part on whether or not added compounds are present that are sensitive to or reactive with the anion.

The photograpic material, according to the invention, containing the cobalt(III) amine salt optionally comprises compounds or compositions useful in imaging in addition to the described compounds. Such materials are, for example, dye-forming materials or dyes which are bleachable in response to ammonia or amines. Examples of dye-forming materials which also comprise destabilizer materials to interact with the cobalt(III) amine complex are known in the photographic art such as described in U.S. Pat. No. 4,273,860, which is incorporated herein by reference. Such dye-forming materials include, for example, 4-methoxynaphthol which forms a blue dye when oxidized and protonated diamine destabilizer material which when associated with a conventional color coupler will form a dye when it is oxidized by the reduction of the cobalt(III) amine complex. Examples of image-forming materials useful in addition to the cobalt(III) amine complex include phthalaldehyde, also present as an amplifier; and ammonia-bleachable or color alterable dye such as a cyanine dye, styryl dye, rhodamine dye, azo dye or pyrylium dye; a dye precursor such as a ninhydrin; or a diazo coupler material which is capable of forming an azo dye. Details of these examples are described in, for example, *Research Disclosure,* October 1974, Item No. 12617, the disclosure of which is incorporated herein by reference. Another optional addenda is a compound which will chelate with the cobalt(III) to form a dye.

When ammonia-bleachable materials are present in the photographic element, according to the invention, the ammonia-bleachable materials are preferably in a layer separate from the ammonia producing components of the material. A partial list of illustrative cobalt-(III) amine complexes that are useful in photographic materials, according to the invention, is as follows:

Cobalt(III) hexammine benzilate
Cobalt(III) hexammine perfluorobenzoate
Cobalt(III) hexammine thiocyanate
Cobalt(III) hexammine trifluoromethane sulfonate
Cobalt(III) hexammine trifluoroacetate
Cobalt(III) hexammine heptafluorobutyrate
Cobalt(III) chloropentammine perchlorate
Cobalt(III) bromopentammine perchlorate
Cobalt(III) aquopentammine perchlorate
Cobalt(III) bis(methylamine)tetra-ammine hexafluorophosphate
Cobalt(III) trinitrotris-ammine
Cobalt(III) penta-ammine carbonato perchlorate
Tris(glycinato) cobalt(III)
Tris(trimethylenediamine) cobalt(III) trifluoromethanesulfonate
Cobalt(III) tri(trimethylenediamine) tetrafluoroborate
Bis(ethylenediamine) bisazido cobalt(III) perchlorate
Triethylenetetraaminedichloro cobalt(III) trifluoroacetate
Aquopenta(methylamine) cobalt(III) nitrate
Chloropenta(ethylamine) cobalt(III) pentafluorobutanoate
Trinitrotris(methylamine) cobalt(III)
Tris(ethylenediamine) cobalt(III) trifluoroacetate
Cobalt(III) hexamethylamine chloride or bromide
Cobalt(III) hexabutylamine chloride or bromide
Cobalt(III) hexaoctylamine chloride or bromide Further description of such cobalt(III) amine complexes is found in U.S. Pat. No. 4,308,341. Combinations of cobalt(III) amine salts are also useful.

The concentration of cobalt(III) amine salt is sufficient to enable heat erasing of latent image silver in a photographic element upon initial heating of the photographic material according to the invention. The optimum concentration for enabling erasing of latent image silver in the photographic silver halide will depend upon such factors as the particular photographic silver halide, other components in the photographic material, processing conditions, and the particular cobalt(III) amine salt. A preferred concentration of cobalt(III) amine salt is within the range of about 0.01 to about 0.5 mmoles of cobalt(III) amine salt per mole of photographic silver halide in the photographic material.

A photographic material, according to the invention, is preferably a photothermographic material. Photothermographic silver halide materials which can be prepared to be heat erasable photothermographic materials according to the invention, are described in, for example, *Research Disclosure, June* 1978, Item No. 17029 which is incorporated herein by reference. An example of such a photothermographic material comprises:

(a) photographic silver halide;
(b) a mild oxidizing agent which consists essentially of a cobalt(III) amine salt as described;
(c) a weak complexing agent for the oxidized silver;
(d) an incorporated silver halide developing agent which does not adversely affect heat erasing of latent image silver according to the invention, such as ascorbic acid;
(e) a vehicle or binder, such as a hydrophilic vehicle or binder;

and preferably an activator or activator stabilizer with preferably a stabilizer or stabilizer precursor. Such a photothermographic material is designed to produce an image by dry chemical development.

A variety of silver halide developing agents are useful in a photothermographic material, according to the invention, designed to produce an image by dry chemical development. Examples of useful silver halide developing agents in such a photothermographic material include aminohydroxycycloalkenone compounds, such as 2-hydroxy-3-piperidino-2-cyclohexenone, 2-hydroxy-3-morpholino-3-cyclohexenone and 2-hydroxy-3-piperidino-2-cyclopentanone, as well as 3-dimethylamino-2-hydroxy-2-cyclohexenone; esters of amino reductones such as piperidinohexose reductone monoacetate; N-hydroxyurea derivatives, such as N-p-methylphenyl-N-hydroxyurea and N-phenyl-N-hdroxyurea; hydrazones, such as N-methylbenzothiazolidenebenzene sulfonylhydrazone; phosphoraminophenols and phosphoraminoanilines; polyhydroxybenzenes, such as hydroquinone, tertiarybutyl-hydroquinone, isopropyl hydroquinone; (2,5-di-hydroxyphenyl)methylsulfone; sulfhydroxamic acids, such as benzenesulfhydroxamic acid, perbromophenylsulfhydroxamic acid and 2,5-dichlorophenylsulfhydroxamic acid; sulfonamidoanilines, such as 4-(N-methanesulfonamido)aniline and 4-(N-benzenesulfonamido)-2-methoxyaniline hydrochloride; 2-tetrazolylthiohydroquinones and tetrahydroquinoxalines. Reductic acid silver halide developing agents such as ascorbic acid and ascorbic acid derivatives are highly preferred.

A variety of optional activators and activator precursors are useful in photothermographic materials according to the invention. Examples of such activators and activator precursors are dicarboxylated amine salts such piperidinium dichloroacetate, morpholinium trichloroacetate and quinadinium trichloroacetate; aminimides, cyclicaminimides and polymeric aminimides, such as 1,1-dimethyl-1-(2-hydroxypropyl)-amineadipimide, 1,1-dimethyl-1-(2-hydroxypropyl)-aminemethacrylimide, and poly(1,1-dimethyl-1-(2-hydroxypropyl)aminemethacrylimide. Combinations of activators and activator precursors are also useful. The activators and activator precursors are base generating materials in the photothermographic material upon heating.

Another form of photothermographic material,according to the invention, comprises a photothermographic silver halide material designed for dry physical development. Such a photothermographic material, according to the invention, comprises, in reactive association, in a binder, such as polyvinylbutyral:

(a) photographic silver halide;
(b) a mild oxidizing agent consisting essentially of at least one cobalt(III) amine salt as described above;
(c) an oxidation-reduction image-forming combination comprising
  (i) an organic metal salt oxidizing agent such as an organic silver salt oxidizing agent with
  (ii) an organic reducing agent for the organic metal salt oxidizing agent; and
(d) a weak complexing agent of oxidized silver.

A variety of organic silver salt oxidizing agents are useful in a photothermographic material according to the invention. Examples of useful organic silver salt oxidizing agents are described in, for example, *Research Disclosure, June* 1978, Item No. 17029, the description of which is incorporated herein by reference. It is important that the organic silver salt oxidizing agent not adversely affect either the temporary desensitization to light of the photothermographic material or the sensitization to light upon uniform heating. Examples of useful organic silver salt oxidizing agents include silver behenate, silver palmatate, silver stearate as described in, for example, *Research Disclosure,* Item No. 17029. Other useful silver salt oxidizing agents include, for example, silver salts of 1,2,4-mercaptotrizole derivatives, such as described in *Research Disclosure,* June 1977, Item No. 15869, the description of which is incorporated herein by reference. Another useful class of organic silver salt oxidizing agents includes complexes or salts of silver with a nitrogen acid, such as a nitrogen acid selected from the group consisting of imidazole, pyrazole, urazole, 1,2,4-triazole and 1H-tetrazole nitrogen acids or combinations of these acids. These silver salts or complexes of nitrogen acids are described in, for example, *Research Disclosure,* October 1976, Item No. 15026, the disclosure of which is incorporated herein by reference. Examples of useful silver salts or complexes of nitrogen acids include silver salts or complexes of 1H-tetrazole; dodecyltetrazole; 5-n-butyl-1H-tetrazole; 1,2,4-triazole; urazole; pyrazole; imidazole and benzimidazole. Selection of an optimum organic silver salt or complex oxidizing agent, or combination of such oxidizing agents, will depend upon such factors as the desired image, particular silver halide, particular cobalt(III) amine salt, processing conditions, particular reducing agent and the weak complexing agent for oxidized silver.

The terms "salt" and "complex" herein include any type of bonding or complexing mechanism which enables the resulting material to provide desired imaging properties in the photographic materials according to the invention. In some instances, the exact bonding of the described salt or complex is not fully understood. The terms "salt" and "complex" include neutral complexes and non-neutral complexes.

A preferred embodiment of the invention comprises a photographic element comprising a support having thereon at least one photographic silver halide emulsion layer comprising in a hydrophilic binder, such as a gelatino binder, the combination of:

(a) photographic silver halide;
(b) a concentration within the range of about 1 to about 50 mg per millimole of silver of cobalt(III) hexammine trifluoroacetate; and
(c) a concentration within the range of about 10 to about 200 mg per millimole of silver of methylurea.

In photothermographic silver halide materials, according to the invention, it is generally desirable to have a stabilizer or stabilizer precursor in the photothermographic material to provide improved post-processing image stability. It is desirable in most instances to stabilize the silver halide after processing in order to avoid post-processing print-up. A variety of stabilizers and stabilizer precursors are useful in the photographic materials according to the invention. The stabilizers and stabilizer precursors are useful alone or in combination. Generally useful stabilizers and stabilizer precursors are sulfur compounds that form a stable silver mercaptide after image development with the photosensitive silver material at processing temperatures. It is important to select stabilizers or stabilizer precursors that do not prestabilize the silver halide during the initial heating step before imagewise exposure. Photolytically active halogen-containing organic compounds are also useful in some photothermographic materials according to the invention. Such stabilizers and stabilizer precursors are described in, for example, *Research Disclosure,* June 1978, Item No. 17029, the description of which is incorporated herein by reference. Selection of an optimum stabilizer or stabilizer precursor or combination thereof will depend upon such factors as the particular photographic silver halide, the particular cobalt(III) amine salt, processing conditions, desired image and other components in the photothermographic material. The photothermographic material, according to the invention, optionally comprises an image toner to aid in producing a more neutral appearing or black tone image upon processing when such a black image is desired. Combinations of image toners are also optionally useful. Examples of toning agents are described in, for example, *Research Disclosure,* June 1978, Item No. 17029, the description of which is incorporated herein by reference. Examples of useful toning agents include phthalazinone, phthalimide, phthalazine, succinimide and hydantoin.

The photographic materials, according to the invention, generally comprise a binder. Binders are useful alone or in combination in a photographic material according to the invention. Useful binders include both naturally occurring substances such as proteins, for example, gelatin, gelatin derivatives, cellulose derivatives, polysaccarides, such as dextran, gum arabic and the like; and synthetic polymeric materials which are compatible with the photographic silver halide and cobalt(III) amine compounds, such as acrylamide polymers. Binders which are particularly compatible with cobalt(III) complexes are preferred, for example, those binders listed in *Research Disclosure,* Item No. 18436. Examples of such preferred binders include certain polysulfonamides, for example, poly(ethylene-co-1,4-cyclohexylenedimethylene-1-methyl-2,4-benzenedisulfonamide) and poly(ethylene-co-hexamethylene-1-methyl-2,4-benzene-disulfonamide), and poly(methacrylonitrile).

If desired, the photographic elements, according to the invention, contain an overcoat layer and/or subbing layer to provide desired properties. The overcoat layer, for example, increases resistance to abrasion and other markings on the element. The overcoat layer and/or subbing layer contain, alone or in combination, vehicles and binders that are useful in the layer of the element containing the silver halide. Gelatin is especially useful.

A photographic element, according to the invention, generally comprises a support. A support is necessary in those instances in which the photographic coatings are not self-supporting. Any conventional photographic support is useful according to the invention. Examples of preferred supports include transparent supports, such as film supports and glass supports, as well as opaque supports, such as metal and paper supports. The support is preferred which is resistant to adverse changes in structure due to processing conditions and which does not adversely affect the desired sensitometric properties of the photographic materials. Examples of useful film supports include cellulose ester, poly(vinylacetal), poly(ethylene terephthalate) and polycarbonate films as well as related films and resinous materials. A flexible support is generally most useful. The support optionally comprises one or more subbing layers for the purpose of altering its surface properties to enhance adhesion of the layers to the support.

The composition coated on the support is generally coated from an aqueous solvent. If desired, organic solvents are also useful alone or in combination. Such organic solvents include, for example, lower alkanols such as methanol, ethanol, isopropanol and tertiarybutanol. Ketones are also useful, such as methylethyl ketone, acetone and methylisobutyl ketone. Other useful solvents include ethers, such as tetrahydrofuran, acetonitrile, dimethylsulfoxide and dimethylformamide.

The photographic materials, according to the invention, are coated by procedures known in the photographic art. Such procedures include, for example, immersion or dip coating, roller coating, reverse roll coating, air knife coating, doctor blade coating, spray coating, extrusion coating, dip coating, stretch flow coating and curtain coating.

After initial heating of the photographic material, according to the invention, the photographic materials are generally imagewise exposed by various forms of energy to produce a developable image in the photographic material. Such forms of energy include those to which the photographic material, especially the photographic silver halide, is sensitive. These forms of energy encompass the ultraviolet, visible and infrared regions of the electromagnetic spectrum, as well as electron beam and beta radiation, gamma ray, x-ray, alpha-particle, neutron radiation and other forms of corpuscular radiant energy in either noncoherent (random phase) forms or coherent (in phase) forms as produced by lasers. Exposures are monochromatic, orthochromatic or panchromatic, depending upon the spectral sensitization of the photographic silver halide. Imagewise exposure is generally for a sufficient time and intensity to produce a developable latent image in the photographic material.

A method of producing an image in a photographic element comprises the steps in sequence:

(A) heating the element, preferably uniformly, at a temperature and for at time sufficient to erase any latent image silver in or on the photographic silver halide;

(B) exposing the element resulting from step (A) to light to produce a developable image in the silver halide photographic emulsion layer; then (C) developing the image produced in step (B).

The development step is preferably carried out in (C) by contacting the exposed element with an aqueous photographic silver halide developer composition.

A preferred method of producing an image in a photographic element comprising a support having thereon at least one silver halide photographic emulsion layer comprising, in a gelatino binder:

(a) photographic silver halide;

(b) a concentration within the range of about 1 to about 50 mg per millimole of silver of cobalt(III) hexammine trifluoroacetate; and (c) a concentration within the range of about 10 to about 200 mg per millimole of silver of a weak complexing agent for oxidized silver, such as methylurea;

comprises the steps, in sequence:

(A) heating the element, preferably uniformly, at a temperature within the range of about 80° C. to about 180° C. for a time sufficient to erase any latent image silver in the silver halide photographic emulsion layer;

(B) exposing the element resulting from step (A) to light, preferably imagewise, to produce a developable image in the silver halide photographic emulsion layer; then (C) developing the image produced in step (B) by means of an aqueous photographic silver halide developer composition and then fixing the resulting photographic element by means of an aqueous photographic silver halide fixing composition.

A photographic element, according to the invention, which is not a photothermographic element, optionally comprises a photographic silver halide developing agent. Such photographic silver halide developing agents can be selected from those described in, for example, *Research Disclosure,* December, 1978, Item No. 17643, which is incorporated herein by reference. A method of producing an image in such a photographic element according to the invention comprising an incorporated silver halide developing agent; comprises the steps, in sequence:

(A) heating the element at a temperature and for a time sufficient to erase any latent image silver in the photographic element;

(B) exposing the element resulting from step (A) to light, preferably imagewise, to produce a developable image in the silver halide photographic emulsion layer; then (C) developing the image produced in step (B) by means of an aqueous alkaline solution comprising a base which is capable of activating the developing agent.

Bases which are useful in the aqueous alkaline solution include those bases known in the photographic art for activating silver halide developing agents, such as sodium hydroxide, potassium hydroxide and sodium methoxide.

Following development the resulting photographic element is preferably fixed or stabilized by means of a silver halide fixing or stabilizing composition. Fixing or stabilizing compositions that are useful according to the invention, are known in the photographic art and include, for example, sodium thiosulfate and thiocyanate fixing or stabilizing compositions and those described in, for example "Modern Photographic Processing" by Grant Haist, John Wiley & Sons Inc., 1979, pages 558 through 607 in Vol. 1 and pages 210 through 272 in Vol. 2.

A photothermographic material, according to the invention, optionally comprises at least one material that is responsive to the presence of ammonia or an amine released from the cobalt(III) amine salt in the photographic material. For example, a photothermographic element, according to the invention, optionally comprises a support having thereon at least first and second contiguous layers, and in a hydrophilic binder, in reactive association, photographic silver halide, and a silver halide developing agent wherein:

(A) the first layer comprises an amine responsive non-silver imaging composition; and, contiguous to the first layer the element comprises, (B) a second layer consisting essentially of (a) photographic silver halide, (b) a mild oxidizing agent consisting essentially of a cobalt(III) amine salt, (c) a silver halide developing agent, and (d) a weak complexing agent for silver ion.

The first layer comprises, for example, an amine responsive dye-forming imaging composition. An illustrative example of such an amine responsive material is one that comprises an aromatic dialdehyde capable of reacting with ammonia or an amine generated from the cobalt(III) amine salt. Such an aromatic dialdehyde is, for example, orthophthalaldehyde capable of reacting with ammonia or an amine generated from the cobalt(III) amine salt. The contiguous amine responsive layer also preferably comprises a reducible cobalt(III) complex containing releasable amine ligands. Such cobalt(III) complexes are known in the imaging art and are described in the above *Research Disclosure* publications and U.S. Pat. No. 4,273,860, the description of which is incorporated herein by reference.

An illustrative embodiment of such a photothermographic element comprises a support having thereon at least first and second contiguous layers, and in a hydrophilic binder, in reactive association, photographic silver halide, and a silver halide developing agent wherein:

(A) the element comprises a first layer comprising a cobalt(III) amine salt in a polysulfonamide binder; and contiguous to the first layer the element comprises, (B) a second layer consisting essentially of (i) a mild oxidizing agent for latent image silver, (ii) a silver halide developing agent comprising a reductic acid, such as ascorbic acid, (iii) photographic silver halide, and (iv) a weak complexing agent for oxidized silver.

For instance, the element comprises (A) a first layer comprising cobalt(III) hexammine trifluoroacetate in a poly(ethylene-co-1,4-cyclohexalenedimethylene-1-methyl-2,4-benzenedisulfonamide) binder; and contiguous to the first layer, (B) a second layer consisting essentially of (i) a mild oxidizing agent for latent image silver consisting essentially of (ii) a silver halide developing agent comprising ascorbic acid, (iii) photographic silver halide, and (iv) a weak complexing agent for oxidized silver consisting essentially of methylurea.

Heating of a photothermographic element, according to the invention, is carried out until a desired image is developed, typically within about 2 to about 90 seconds. Selection of an optimum time and temperature will depend upon such factors as the desired image, particular components in the photothermographic material, a particular cobalt(III) amine complex and the method of heating.

A variety of means are useful to produce the necessary heating of the photographic material according to the invention, to produce the desired degree of photosensitivity. The heating means is, for example, a suitable hot plate, heated drum, iron, roller, infrared heating means, hot air heating means, microwave heating means or the like. Such means are also useful to produce the necessary heating of a photothermographic material according to the invention, to produce a developed image after exposure.

Heating of the photothermographic material is carried out under ambient conditions of pressure and humidity. Pressures and humidity outside normal atmospheric conditions are optionally useful. Normal atmospheric conditions are preferred for processing according to the invention.

The following examples are included for a further understanding of the invention.

EXAMPLE 1

This illustrates the invention.

Two coating compositions were prepared as follows:

| | Amount: |
|---|---|
| Part (A): | |
| gelatin (deionized, 10% by weight water) | 2.0 g |
| water | 5.0 g |
| surfactant (Surfactant 10G, which is para-isononylphenoxypolyglycidol, a trademark of and available from the Olin Corp., U.S.A.) | 0.20 g |
| methylurea (weak complexing agent for oxidized silver) | 0.11 g |
| ascorbic acid (reducing agent) | 0.12 g |
| silver chloride gelatino emulsion (0.24 μm grain size) | 0.43 g |
| Part (B): | |
| coblat(III) hexammine trifluoroacetate (mild oxidizing agent) | 0.25 g |
| poly(ethylene-co-1,4-cyclohexylene-dimethylene-1-methyl-2,4-benzenedisulfonamide) (binder) | 10.0 g |

Part (A) was coated on a poly(ethylene terephthalate) film support at a wet coating thickness of 101.6 microns (4 mils) by means of a coating knife. The coating was permitted to dry at 60° C. (140° F.) for 10 minutes. Part (B) was then coated on Part (A) at a wet coating thickness of 101.6 microns (4 mils). The resulting layers were allowed to dry at room temperature (about 20° C.) for three hours. Part of the cobalt(III) hexammine trifluoroacetate diffused into the layer containing the silver chloride.

Part of the resulting photographic material was exposed imagewise and part uniformly to fluorescent room light, tungsten light, mercury light and xenon flash followed by heating the material at 120° C. on a heated metal block for 30 seconds. No image or fog was visible after the heating step. Then the photographic material was imagewise exposed to light. The photographic material was then heated at 120° C. on a heated metal block for 30 seconds. A developed image, corresponding to the second exposure, was produced having a maximum density of 1.8 to 2.0 and a minimum density of 0.30. The developed image was neutral (black).

EXAMPLE 2

This illustrates the invention.

The procedure described in Example 1 was repeated with the exception that the initial heating step was varied as indicated in following Table I. The difference between the maximum density and minimum density of the developed image following the second heating step is given in the column headed ΔD in Table I.

TABLE I

| Initial heating step (time in seconds) | ΔD |
|---|---|
| 0 | 0 |
| 3 | 0.23 |

TABLE I-continued

| Initial heating step (time in seconds) | ΔD |
|---|---|
| 5 | 1.09 |
| 10 | 1.18 |
| 20 | 1.22 |

This indicates that as initial heating time increases, the density of the developed image produced during the second heating step increases.

EXAMPLE 3

The procedure described in Example 1 was repeated with the exception that the initial exposure step was omitted and the concentration of cobalt(III) hexammine trifluoroacetate was varied as indicated in following Table II. This variation in concentration of the cobalt compound produced the variations in maximum specular density and minimum specular density indicated in the column headed Dmax/Dmin in Table II.

TABLE II

| Concentration of cobalt(III) hexammine trifluoroacetate ($mg/m^2$) | Dmax/Dmin |
|---|---|
| 0 | 1.68/0.89 |
| 21.6 | 1.45/0.62 |
| 54.0 | 1.58/0.60 |
| 108 | 1.56/0.57 |

This illustrates that the developed image has a lower fog level (Dmin) as the concentration of cobalt(III) hexammine trifluoroacetate is increased.

EXAMPLE 4

The procedure described in Example 1 was repeated with the exception that the silver chloride gelatino emulsion was finer grained (0.14 micron grain size) and the developing agent (0.12 grams of each developing agent) listed in Table III was employed. The results given in following Table III were observed.

TABLE III

| Coating | Developing Agent | Dmax/Dmin of Developed Image |
|---|---|---|
| a | ascorbic acid | 1.58/0.60 |
| b* | 4-hydroxymethyl 4-methyl-1-phenyl-3-pyrazolidone | fogged |
| c* | 1-phenyl-3-pyrazolidone | fogged |
| d* | $CH_3CH_2-N(C_6H_4)-CH_2CH_2OH$ (with $NH_2.HCl$) | fogged |
| e | isopropylpyrimidine | weak image |
| f | hydroquinone | weak image |
| g* | dimethylaminohexose reductone | 0.22/0.14 |
| h | ascorbic acid with 4-hydroxymethyl-4-methyl-1-phenyl-3-pyrazolidone | 0.55/0.41 |

*means comparative example

When the combination of ascorbic acid and 4-hydroxymethyl-4-methyl-1-phenyl-3-pyrazolidone was present in the photographic element, a 0.9 log E higher speed was observed when the element was preheated 5 seconds at 130° C. prior to imagewise exposure and then heated again.

The element containing dimethylaminohexose reductone did not exhibit the temporary desensitization effect that was exhibited in photographic elements according to the invention.

EXAMPLE 5

This illustrates the effect of methylurea, in a photographic element according to the invention.

Materials were prepared as described in Example 1 was repeated with the exception that the concentration of methylurea was varied as shown in Table IV, below.

The elements containing these concentrations of methylurea were imagewise exposed to light in a commercial sensitometer followed by uniformly heating the elements at 120° C. on a hot block for 10 seconds. No developed image or a very feeble image, if any, was observed in each element.

When the elements containing a sufficient concentration of methylurea were first heated to 120° C. for five seconds then the elements could produce a developed image after exposure that had significantly higher maximum density. The results observed are given in the following Table IV:

TABLE IV

| Concentration of methylurea (mg/mmole of silver) | Developed Image Dmax/Dmin |
|---|---|
| 0 (control) | 0.24/0.15 |
| 35 | 0.31/0.15 |
| 55 | 0.90/0.19 |
| 90 | 0.58/0.26 |

A concentration of methylurea of about 50 to about 100 mg/mmole of silver provides significantly increased maximum density compared to the control.

EXAMPLE 6

This illustrates the desired presence of a small concentration of water, such as that available from ambient humidity, in an element as described in Example 1.

Elements prepared as described in Example 1 were desiccated in a vacuum desiccator for 60 minutes and then heated, imagewise exposed and heated again as described in Example 1. The latent images in these elements developed very sluggishly, that is they developed in about 30 seconds at 120° C. to give a Dmax of 0.5 instead of 1.8 as in Example 1.

Elements prepared as described in Example 5 were equilabrated to ambient humidity (about 50% relative humidity) and then heated, imagewise exposed and heated again. The density of the images were then compared to those which were formed with a holding period of several minutes between the initial heating step and the final heating step to allow for humidity equilabration. The results are given in following Table V. The results given in Table V indicate that a minimum holding time of at least several minutes at ambient humidity between the initial heating step and the final heating step was beneficial.

TABLE V

| Methylurea (mg/mmole of silver) | Dmax/Dmin | |
|---|---|---|
| | No holding | With holding |
| 0 | 0.22/0.15 | 0.32/0.17 |
| 35 | 0.20/0.14 | 0.28/0.14 |
| 55 | 0.46/0.18 | 0.72/0.18 |

TABLE V-continued

| Methylurea (mg/mmole of silver) | Dmax/Dmin | |
|---|---|---|
| | No holding | With holding |
| 90 | 0.66/0.23 | 0.57/0.31 |

EXAMPLE 7

This illustrates the effect of varying the weak complexing agent for oxidized silver in a photographic material according to the invention.

Photographic elements were prepared as described in Example 1 with the exception that methylurea was replaced by the same concentration (110 mg/mM Ag of melt former) of other weak complexing agents for oxidized silver listed in the following Table VI.

The photographic elements were first imagewise exposed to various light sources (a tungsten bulb for several seconds; commercial sensitometer for $10^{-3}$ seconds; and fluorescent room light for 30 seconds) and then heated for 10 seconds at 120° C. In each element, no image or a very feeble image, if any, was formed.

When the photographic elements were first uniformly heated at 120° C. for five to ten seconds; then imagewise exposed to light to produce a developable image; and, finally uniformly heated again at 120° C. for ten seconds the photographic elements produced a developed image that exhibited higher maximum density and higher relative speed than the control element with the exception of the element that contained N-methylacetamide. The compound N-methylacetamide under the conditions of this example resulted in a developed image that had lower maximum density and slower speed than the control. N-Methylacetamide is not a weak complexing agent for oxidized silver according to the invention under the conditions of this example.

TABLE VI

| Melt Former (also known as a thermal solvent) | Dmax/Dmin | Speed (Log E) (measured at 0.10 above Dmin) |
|---|---|---|
| A. control | 0.36/0.17 | — |
| B. methylurea | 0.86/0.18 | 1.8 |
| C. 1,3-dimethylurea | 0.98/0.15 | 1.2 |
| D. urea | 1.08/0.33 | 1.8 |
| E. hydantoin | 0.55/0.17 | 1.5 |
| F. succinimide | 0.89/0.32 | 0.15 |
| G. sulfamide ($H_2NSO_2NH_2$) | 0.85/0.18 | 0.9 |
| H. acetamide | 0.47/0.15 | 0.9 |
| I. N—methylacetamide (comparative example) | 0.15/0.12 | (slower than control) |

EXAMPLE 8

This illustrates comparison of various silver halide developing agents in a photographic element comprising silver chloride and cobalt(III) hexammine trifluoroacetate.

The following composition was prepared:

| Component: | Amount: |
|---|---|
| gelatin (10% by weight in water) (binder) | 2.0 g |
| water | 5.0 g |
| surfactant (Surfactant 10G) (10% by weight in water) | 200.0 mg |

-continued

| Component: | Amount: |
|---|---|
| methylurea (melt former) | 110.0 mg |
| AgCl (gelatino AgCl emulsion; 0.24 millimicron grain size) | 430 mg |
| cobalt(III) hexammine trifluoroacetate | 3 mg |
| reducing agent (silver halide developing agent) (identified below) | 120 mg |

The composition was coated on a gelatin-subbed poly(ethylene terephthalate) film support at a wet coating thickness of 101.6 microns (4 mils) at 38° C. (100° F.) and then permitted to dry at 60° C. (140° F.) for ten minutes.

The resulting elements were imagewise exposed to light in a commercial sensitometer and then immersed for 30 seconds in a silver halide developer solution at 25° C. similar to Kodak D-19 Silver Halide Developer comprising

| | |
|---|---|
| water (25° C.) | 500 cc |
| N—methyl-p-aminophenol sulfate | 2.2 g |
| sodium sulfite (anhydrous) | >2 g |
| hydroquinone | 8.8 g |
| sodium carbonate (anhydrous) | 48 g |
| potassium bromide | 4 g |
| water to make 1 liter | |

In each case a developed image was produced (Dmax of 1.8).

To illustrate reversible desensitization, the elements were first imagewise exposed to light, then uniformly heated at 130° C. for 30 seconds, followed by processing in a silver halide developer solution similar to Kodak D-19 Silver Halide Developer. If an image was developed, then it was concluded that the element was not. If no image was formed indicating that heating destroyed the latent image, then further procedures were carried out to illustrate that a heating step caused the element to become sensitive to light. The elements that were considered to provide satisfactory results in these procedures were (a) exposed to light, (b) then heated to erase latent image silver, (c) imagewise exposed to light, and (d) processed in a silver halide developer solution like Kodak D-19 Silver Halide Developer to produce a developed image. The following silver halide developing agents when incorporated in an element according to the invention, as described above, were heat processed (130° C./30 seconds) to provide satisfactory developed images:

(a) ascorbic acid
(b) hydroquinone
(c) 2-isopropyl-4,5,6-trihydroxypyrimidine.

In a comparative procedure, 4-hydroxymethyl-4-methyl-1-phenyl-3-pyrazolidone did not provide satisfactory results when added as a reducing agent to the described element. This silver halide developing agent appeared to have reducing properties that were sufficiently high to destroy the desired action of the cobalt(III) hexammine trifluoroacetate on mixing the composition before coating. The element containing this silver halide developing agent did not appear to be temporarily desensitized to light.

In another comparative procedure, the following silver halide developing agent did not produce satisfactory results:

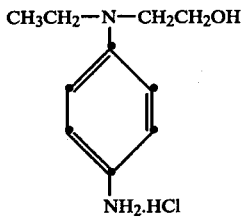

This silver halide developing agent appeared to have reducing properties that were not sufficiently high to allow the desensitization of the silver halide to be reversed even upon heating the element prior to imagewise exposure to light. The element containing this silver halide developing agent permanently lost its light sensitivity upon being heated.

EXAMPLE 9

This illustrates preparation of an element according to the invention in white light, not in dark or safelight conditions.

The following composition in white light was mixed, doctored, coated on a gelatin subbed poly(ethylene terephthalate) film support:

| Component: | Amount: |
|---|---|
| gelatin (10% dry weight in water) (binder) | 2.0 g |
| water | 5.0 g |
| surfactant (surfactant 10G) (10% by weight in water) | 200.0 g |
| methylurea (weak complexing agent for oxidized silver) | 110.0 mg |
| AgCl (gelatino AgCl emulsion; 0.24 millimicron grain size) | 430 mg |
| cobalt(III) hexammine trifluoroacetate (mild oxidizing agent) | 3 mg |
| ascorbic acid (silver halide developing agent) | 120 mg |

When the element was imagewise exposed to light and then processed in a silver halide developer solution like Kodak D-19 Silver Halide Developer, an image was developed with fog in the background areas.

When the element was imagewise exposed to light, then heated in the dark at 130° C. for 30 seconds and finally processed in a silver halide developer solution like Kodak D-19 Silver Halide Developer, no visible developed image was produced.

When the element was exposed to light, then heated in the dark at 130° C. for 30 seconds, then imagewise exposed to light to produce a developable image in the element, and finally processed in a silver halide developer solution like Kodak D-19 Silver Halide Developer, a developed image was produced having a maximum density of 1.0 with a minimum density of 0.005 without fog. The image also exhibited increased photographic speed in the toe region of the H & D curve (0.45 log E faster in the toe region) compared to a control coating which was identical but was coated in the dark and was not heated prior to exposure.

EXAMPLE 10

This illustrates that a silver halide developing agent, such as ascorbic acid, is not necessary in an element according to the invention when the element is to be processed in a silver halide developer solution or bath in the image development step.

An element was prepared as described in Example 8 with the exception that a silver halide developing agent was not included in the element. The same sequence of steps of heating, exposure and processing was carried out as described in Example 8. The results indicated that a similar developed image was produced in the element whether or not the ascorbic acid was present in the element.

EXAMPLE 11

The procedure described in Example 8 was repeated with the exceptions that ascorbic acid was omitted from the element and one of the following silver halide gelatin emulsions replaced the AgCl gelatino emulsion:

(A) AgBr, unsensitized (0.14 millimicron grain size)

(B) AgBrI, chemically sensitized by sulfur and gold chemical sensitization (0.6 millimicron grain size) without dye sensitization (C) AgBrI, chemically sensitized by sulfur and gold chemical sensitization and spectrally sensitized by a cyanine dye.

The listed emulsions exhibited higher photographic speed than the AgCl emulsion of Example 8. Each of the photographic materials produced a satisfactory developed image by the procedure according to Example 8.

The invention has been described in detail with particular reference to preferred embodiments thereof, but it will be understood that variations and modifications can be effected within the spirit and scope of the invention.

What is claimed is:

1. A heat erasable photographic element comprising a support bearing, in a binder, in reactive association:

(a) photographic silver halide;

(b) a mild oxidizing agent which consists essentially of a cobalt(III) amine salt which, upon heating said photographic element, will oxidize any latent image silver in the photographic element; and, (c) a weak complexing agent for the oxidized silver wherein said complexing agent is also a thermal solvent.

2. A heat erasable photographic element comprising a support bearing, in a binder, in reactive association:

(a) photographic silver halide;

(b) a mild oxidizing agent which consists essentially of a cobalt(III) amine salt which, upon heating said photographic element, will oxidize any latent image silver in the photographic element; and, (c) a weak complexing agent for the oxidized silver which is selected from the group consisting of methylurea, N,N-dimethylurea, urea and combinations thereof.

3. A photographic element as in claim 1 wherein said weak complexing agent is present in the element within the range of about 10 to about 200 mg of weak complexing agent per millimole of silver in the photographic emulsion layer.

4. A photographic element as in claim 1 wherein said cobalt(III) amine salt is a cobalt(III) hexammine salt.

5. A photographic element as in claim 1 wherein said cobalt(III) amine salt is cobalt(III) hexammine trifluoroacetate.

6. A photographic element as in claim 1 wherein said cobalt(III) amine salt is present in the element within the range of about 1 to about 50 mg of cobalt(III) amine salt per millimole of silver in said element.

7. A heat erasable photographic element comprising a support bearing, in a hydrophilic binder, in reactive association:

(a) photographic silver halide;

(b) a mild oxidizing agent which consists essentially of a concentration within the range of about 1 to about 50 mg of cobalt(III) hexammine trifluoroacetate per millimole of silver in the photographic element; and, (c) a weak complexing agent for the oxidized silver which consists essentially of a concentration within the range of about 10 to about 200 mg of methylurea per millimole of silver in the photographic element.

8. A heat erasable photographic composition comprising:

(a) photographic silver halide;

(b) a mild oxidizing agent which consists essentially of a cobalt(III) amine salt which, upon heating said photographic composition, will oxidize any latent image silver in the photographic composition; and, (c) a weak complexing agent for the oxidized silver wherein said complexing agent is also a thermal solvent.

9. A heat erasable photographic composition comprising:

(a) photographic silver halide;

(b) a mild oxidizing agent which consists essentially of a cobalt(III) amine salt which, upon heating said photographic composition, will oxidize any latent image silver in the photographic composition; and, (c) a weak complexing agent for the oxidized silver which is a compound selected from the group consisting of methylurea, N,N-dimethylurea, urea and combinations thereof.

10. A photographic composition as in claim 8 wherein said weak complexing agent is present in the composition within the range of about 10 to about 200 mg of weak complexing agent per millimole of silver in the photographic composition.

11. A photographic composition as in claim 8 wherein said cobalt(III) amine salt consists essentially of a cobalt(III) hexammine salt.

12. A photographic composition as in claim 8 wherein said cobalt(III) amine salt consists essentially of a cobalt(III) hexammine salt and said weak complexing agent consists essentially of methyl urea.

13. A photographic composition as in claim 8 wherein said cobalt(III) amine salt consists essentially of cobalt(II) hexammine trifluoroacetate.

14. A photographic composition as in claim 8 wherein said cobalt(III) amine salt is present in the composition within the range of about 1 to about 50 mg of cobalt(III) amine salt per millimole of silver in said photographic composition.

15. A heat erasable photographic composition comprising, in a hydrophilic binder:

(a) photographic silver halide;

(b) a mild oxidizing agent which consists essentially of a concentration within the range of about 1 to about 50 mg of cobalt(III) hexammine trifluoroacetate per millimole of silver in the photographic composition; and, (c) a weak complexing agent for the oxidized silver which consists essentially of a concentration within the range of about 10 to about 200 mg of methylurea per millimole of silver in the photographic composition.

16. A heat erasable photographic composition comprising, in a hydrophilic binder:

(a) photographic silver halide;

(b) a mild oxidizing agent which consists essentially of a concentration within the range of about 1 to about 50 mg of cobalt(III) hexammine trifluoroacetate per millimole of silver in the photographic composition; and, (c) a weak complexing agent for the oxidized silver which consists essentially of a concentration within the range of about 10 to about 200 mg of methylurea per millimole of silver in the photographic composition.

17. A method of producing an image in a heat erasable photographic element comprising a support bearing, in a binder, in reactive association:

(a) photographic silver halide;

(b) a mild oxidizing agent which consists essentially of a cobalt(III) amine salt which, upon heating said photographic element, will oxidize any latent image silver in the photographic element; and, (c) a weak complexing agent for the oxidized silver wherein said complexing agent is also a thermal solvent;

said method comprising the steps, in sequence:

(A) heating said element at a temperature and for a time sufficient to erase any latent image silver in the photographic element;

(B) exposing the element resulting from step (A) to light to produce a developable image in the silver halide photographic emulsion layer; then (C) developing the image produced in step (B).

18. A method as in claim 17 comprising in (C) contacting said element with an aqueous photographic silver halide developer composition.

19. A method of producing an image in a heat erasable photographic element comprising a support bearing a photographic emulsion layer comprising, in a gelatino binder:

(a) photographic silver halide;

(b) a mild oxidizing agent which consists essentially of a concentration within the range of about 1 to about 50 mg of cobalt(III) hexammine trifluoroacetate per millimole of silver in the photographic emulsion; and, (c) a weak complexing agent for oxidized silver which consists essentially of a concentration within the range of about 10 to about 200 mg of methylurea per millimole of silver in the photographic emulsion;

said method comprising the steps, in sequence:

(A) heating said element at a temperature within the range of 80° C. to 180° C. for a time sufficient to erase any latent image silver in the photographic element;

(B) exposing the element resulting from (A) to light to produce a developable image in the silver halide photographic emulsion layer; then (C) developing the image produced in (B) by means of an aqueous photographic silver halide developer composition and then fixing or stabilizing the resulting photographic element by means of an aqueous photographic silver halide fixing or stabilizing composition.

20. A heat erasable photothermographic element comprising a support bearing, in a hydrophilic binder, in reactive association:
(a) photographic silver halide;
(b) a mild oxidizing agent which consists essentially of a cobalt(III) amine salt which, upon initial heating said photothermographic element, will oxidize any latent image silver in the photothermographic element;
(c) a weak complexing agent for the oxidized silver wherein said complexing agent is also a thermal solvent; and,
(d) a silver halide developing agent which is capable of reducing neither the cobalt(III) amine salt nor exposed silver halide upon initial heating of said photothermographic element; and, which is capable of developing exposed silver halide upon a second heating of said photothermographic element to a temperature within the range of 80° C. to 180° C.

21. A heat erasable photothermographic element comprising a support bearing, in a hydrophilic binder, in reactive association:
(a) photographic silver halide;
(b) a mild oxidizing agent which consists essentially of a cobalt(III) amine salt which, upon initial heating said photothermographic element, will oxidize any latent image silver in the photothermographic element;
(c) a weak complexing agent for the oxidized silver which is a compound selected from the group consisting of methylurea, N,N-dimethylurea, urea and combinations thereof; and
(d) a silver halide developing agent which is capable of reducing neither the cobalt(III) amine salt nor exposed silver halide upon initial heating of said photothermographic element; and, which is capable of developing exposed silver halide upon a second heating of said photothermographic element to a temperature within the range of 80° C. to 180° C.

22. A photothermographic element as in claim 20 wherein said weak complexing agent is present in said photothermographic element in a concentration within the range of about 10 to about 200 mg of weak complexing agent per millimole of silver in the photothermographic element.

23. A photothermographic element as in claim 20 wherein said cobalt(III) amine salt is a cobalt(III) hexammine salt.

24. A photothermographic element as in claim 20 wherein said cobalt(III) amine salt is cobalt(III) hexammine trifluoroacetate.

25. A photothermographic element as in claim 20 wherein said cobalt(III) amine salt is present in said photothermographic element within the range of about 1 to about 50 mg of cobalt(III) amine salt per millimole of silver in said photothermographic element.

26. A photothermographic element as in claim 20 wherein said developing agent comprises a reductic acid silver halide developing agent.

27. A photothermographic element as in claim 20 wherein said developing agent comprises ascorbic acid.

28. A heat erasable photothermographic element comprising a support bearing, in a hydrophilic binder, in reactive association:
(a) photographic silver halide;
(b) a mild oxidizing agent which consists essentially of a cobalt(III) hexammine trifluoroacetate which, upon initial heating said photothermographic element, will oxidize any latent image silver in the photothermographic element;
(c) a weak complexing agent for oxidized silver consisting essentially of methylurea; and,
(d) a silver halide developing agent consisting essentially of ascorbic acid.

29. A heat erasable photothermographic element comprising a support bearing:
(A) a layer comprising an amine responsive non-silver imaging composition; and contiguous to (A);
(B) a layer comprising, in a hydrophilic binder:
(a) photographic silver halide;
(b) a mild oxidizing agent which consists essentially of a cobalt(III) amine salt which, upon initial heating said photothermographic element, will oxidize any latent image silver in the photothermographic element;
(c) a weak complexing agent for the oxidized silver wherein said complexing agent is also a thermal solvent; and,
(d) a silver halide developing agent which is capable of reducing neither the cobalt(III) amine salt nor exposed silver halide upon initial heating of said photothermographic element; but, which is capable of developing exposed silver halide upon a second heating of said photothermographic element.

30. A photothermographic element at in claim 29 wherein said layer (A) comprises an amine responsive cobalt imaging composition.

31. A photothermographic element as in claim 29 wherein said layer (A) comprises an amine responsive dye-forming imaging composition.

32. A heat erasable photothermographic element comprising a support bearing:
(A) a layer comprising an amine responsive non-silver imaging composition; and contiguous to (A);
(B) a layer comprising, in a hydrophilic binder:
(a) photographic silver halide;
(b) a mild oxidizing agent which consists essentially of a cobalt(III) amine salt which, upon initial heating said photothermographic element, will oxidize any latent image silver in the photothermographic element;
(c) a weak complexing agent for the oxidized silver which is a compound selected from the group consisting of methylurea, N,N-dimethylurea, urea and combinations thereof; and,
(d) a silver halide developing agent which is capable of reducing neither the cobalt(III) amine salt nor exposed silver halide upon initial heating of said photothermographic element; but, which is capable of developing exposed silver halide upon a second heating of said photothermographic element.

33. A photothermographic element as in claim 29 wherein said weak complexing agent is present in said layer (B) in a concentration within the range of about 10 to about 200 mg of weak complexing agent per millimole of silver in the photographic element.

34. A photothermographic element as in claim 29 wherein said cobalt(III) amine salt consists essentially of a cobalt(III) ammine salt.

35. A photothermographic element as in claim 29 wherein said cobalt(III) amine salt consists essentially of cobalt(III) hexammine trifluoroacetate.

36. A photothermographic element as in claim 29 wherein said cobalt(III) amine salt is present in said layer (B) in a concentration within the range of about 1 to about 50 mg of cobalt(III) amine salt per millimole of silver in said photothermographic element.

37. A photothermographic element as in claim 29 wherein said silver halide developing agent comprises a reductic acid silver halide developing agent.

38. A photothermographic element as in claim 29 wherein said silver halide developing agent comprises ascorbic acid.

39. A heat erasable photothermographic element comprising a support bearing:

(A) a layer comprising cobalt(III) hexammine trifluoroacetate in a poly(ethylene-co-1,4-cyclohexylenedimethylene-1-methyl-2,4-benzenedisulfonamide) binder; and contiguous to (A);

(B) a layer comprising, in a hydrophilic binder:

(a) photographic silver halide;

(b) a mild oxidizing agent which consists essentially of a cobalt(III) ammine trifluoroacetate which, upon initial heating said photothermographic element, will oxidize any latent image silver in the photothermographic element;

(c) a weak complexing agent for the oxidized silver consisting essentially of methylurea; and (d) a silver halide developing agent consisting essentially of ascorbic acid.

40. A heat erasable photothermographic composition comprising:

(a) photographic silver halide;

(b) a mild oxidizing agent which consists essentially of a cobalt(III) amine salt which, upon initial heating said photothermographic composition, will oxidize any latent image silver in the photothermographic composition;

(c) a weak complexing agent for the oxidized silver wherein said complexing agent is also a thermal solvent; and, (d) a silver halide developing agent which is capable of reducing neither the cobalt(III) amine salt nor exposed silver halide upon initial heating of said photothermographic composition; and, which is capable of developing exposed silver halide upon a second heating of said photothermographic composition to a temperature within the range of 80° C. to 180° C.

41. A photothermographic composition as in claim 40 also comprising a binder.

42. A photothermographic composition as in claim 40, also comprising a gelatino binder.

43. A heat erasable photothermographic composition comprising:

(a) photographic silver halide;

(b) a mild oxidizing agent which consists essentially of a cobalt(III) amine salt which, upon initial heating said photothermographic composition, will oxidize any latent image silver in the photothermographic composition;

(c) a weak complexing agent for the oxidized silver which is a compound selected from the group consisting of methylurea, N,N-dimethylurea, urea and combinations thereof; and, (d) a silver halide developing agent which is capable of reducing neither the cobalt(III) amine salt nor exposed silver halide upon initial heating of said photothermographic composition; and, which is capable of developing exposed silver halide upon a second heating of said photothermographic composition to a temperature within the range of 80° C. to 180° C.

44. A photothermographic composition as in claim 40 wherein said weak complexing agent for oxidized silver is present in a concentration within the range of about 10 to about 200 mg of weak complexing agent per millimole of silver in the photothermographic composition.

45. A photothermographic composition as in claim 40 wherein said cobalt(III) amine salt is a cobalt(III) hexammine salt.

46. A photothermographic composition as in claim 40 wherein said cobalt(III) amine salt is cobalt(III) hexammine trifluoroacetate.

47. A photothermographic composition as in claim 40 wherein said cobalt(III) amine salt is present in a concentration within the range of about 1 to about 50 mg of cobalt(III) amine salt per millimole of silver in said photothermographic composition.

48. A photothermographic composition as in claim 40 wherein said developing agent comprises a reductic acid silver halide developing agent.

49. A photothermographic composition as in claim 40 wherein said developing agent comprises ascorbic acid.

50. A heat erasable photothermographic composition comprising, in a gelatino binder:

(a) photographic silver halide;

(b) a mild oxidizing agent which consists essentially of a concentration within the range of about 1 to about 50 mg of cobalt(III) hexammine trifluoroacetate per millimole of silver in the photothermographic composition;

(c) a weak complexing agent for oxidized silver consisting essentially of a concentration within the range of about 10 to about 200 mg of methylurea per millimole of silver in the photothermographic composition; and, (d) a silver halide developing agent consisting essentially of ascorbic acid.

51. A method of producing an image in a heat erasable photothermographic element comprising a support bearing, in a hydrophilic binder, in reactive association:

(a) photographic silver halide;

(b) a mild oxidizing agent which consists essentially of a cobalt(III) amine salt which, upon heating said photothermographic element, will oxidize any latent image silver in the photothermographic element;

(c) a weak complexing agent for the oxidized silver; and, (d) a silver halide developing agent which is capable of reducing neither the cobalt(III) amine salt nor exposed silver halide upon initial heating of said photothermographic element;

said method comprising the steps, in sequence:

(A) heating said element at a temperature and for a time sufficient to erase any latent image silver in the photothermographic element;

(B) exposing the element resulting from (A) to light to produce a developable image in the photothermographic element; then (C) heating the exposed photothermographic element to a temperature within the range of 80° C. to 180° C. until said image is developed.

52. A method as in claim 51, also comprising stabilizing or fixing the image resulting from (C).

53. A method of producing an image in a heat erasable photothermographic element comprising a support bearing, in reactive association, in a gelatino binder:

(a) photographic silver halide;

(b) a mild oxidizing agent which consists essentially of a concentration within the range of about 1 to about 50 mg of cobalt(III) hexammine trifluoroacetate per millimole of silver in the photothermographic element;

(c) a weak complexing agent for oxidized silver which consists essentially of a concentration within the range of about 10 to about 200 mg of methylurea per millimole of silver in the photothermographic composition;

(d) a silver halide developing agent which consists essentially of ascorbic acid;

said method comprising the steps, in sequence:

(A) heating said element at a temperature within the range of 80° C. to 180° C. for a time sufficient to erase any latent image silver in the photothermographic element;

(B) exposing the element resulting from (A) to light to produce a developable image in the photothermographic element; then, (C) heating the element from (B) to a temperature within the range of 80° C. to 180° C. until said image is developed.

* * * * *